US006032009A

United States Patent [19]

Fukuzawa et al.

[11] Patent Number: 6,032,009

[45] Date of Patent: Feb. 29, 2000

[54] IMAGE READING APPARATUS

[75] Inventors: Nobumasa Fukuzawa, Yokohama; Yoshiyuki Koshimizu, Abiko, both of Japan

[73] Assignee: Canon Kabushiki Kaisha, Tokyo, Japan

[21] Appl. No.: 09/148,468

[22] Filed: Sep. 8, 1998

[30] Foreign Application Priority Data

Sep. 11, 1997 [JP] Japan ..... 9-264919

[51] Int. Cl.[7] ..... G03G 15/041

[52] U.S. Cl. ..... 399/198; 355/55

[58] Field of Search ..... 399/196–202, 399/206–216; 362/321; 355/71, 55

[56] References Cited

U.S. PATENT DOCUMENTS 3,438,704 4/1969 Schoen .
4,113,373 9/1978 Eppe et al. .
4,806,989 2/1989 Saito et al. .
5,283,698 2/1994 Fukuzawa et al. ..... 359/896
5,355,198 10/1994 Saito .
5,412,201 5/1995 Fukuzawa et al. ..... 250/208.1
5,854,688 12/1998 Fukuzawa ..... 358/296

*Primary Examiner*—Richard Moses
*Attorney, Agent, or Firm*—Fitzpatrick, Cella, Harper & Scinto

[57] ABSTRACT

In an image reading apparatus, an image is illuminated to be guided as a light beam to a photosensitive drum through an image forming lens. Light amount correcting members are attached to a movable member movably attached relatively to the image forming lens. The movable member moves in the optical axis direction in accordance with movement of the image forming lens, and one of the light amount correcting members farther from the image forming lens is caused to face a corresponding surface of the image forming lens so as to intercept a part of the light beam from the image in association with the movement of the movable member. The other of the light amount correcting members closer to the image forming lens is caused to retract from a corresponding surface of the image forming lens in association with the movement of the movable member.

8 Claims, 5 Drawing Sheets

IMAGE READING APPARATUS

BACKGROUND OF THE INVENTION

1. Field of the Invention

The present invention relates to an image reading apparatus and, more particularly, to an image reading apparatus for accurately reading or writing an image on an original surface by correcting an uneven light amount on the surface of a reading means, even when the magnification is changed, by intercepting the part of a light beams emanating from the image illuminated by an illuminating means by using light amount correcting members attached to the image forming lens (image forming means) via movable members. This type of image reading apparatus is suitably used is a copying machine.

2. Related Background Art

In conventional image reading apparatuses such as found is a scanning exposure copying machine capable of changing the copying magnification, the surface of an original placed on an original plate is illuminated by a bar-like light source such as a halogen lamp or a fluorescent lamp. The light beams reflected from the original surface are focused on the exposure surface of a photosensitive member by an image forming lens. Image information form the original is sequentially written on the exposure surface of the photosensitive member by changing the relative position of the original surface and the photosensitive member, i.e., by scanning.

Generally, the light amount on the edge of the image forming surface of an optical lens, such as when used as an image forming lens is attenuated in proportion to $\cos^4 \theta$, (where $\theta$ is the angle of incidence of the light). Accordingly, in an image reading apparatus using such an optical lens as a projecting lens, the illuminance on the exposure surface of a photosensitive member is high in its central portion and low in its peripheral portion. This uneven amount of light appears as an uneven density on the outputted image, or photocopy.

In some conventional image reading apparatuses, the illuminance distribution of a light source, or the width of a slit through which a reflected light beam from an original surface passes, is changed so that the edge of an image forming lens is brighter than its center. However, when copying is performed while the magnification is changed, the angle of view changes in accordance with the magnification change. This results in a nonuniform exposure surface illuminance distribution of a photosensitive member.

To prevent this, therefore, a light amount correcting plate which covers a wider area of the center of an image forming lens than the area of the edge of the lens is always placed at a fixed distance from the image forming lens. Consequently, an uneven light amount in the center and the edge of the image forming lens is corrected, and this makes the exposure surface illuminance of a photosensitive member uniform. In this method, the exposure surface illuminance can be made nearly uniform even if the angle of view changes when the magnification is changed.

Unfortunately, the effect of the light amount correcting plate can be obtained only when the plate is placed in a position where light beams from the center and the edge of the image forming lens separate to some extent. Usually, the effect of the light amount correcting plate can be obtained if the gap from the end face (lens surface) of the image forming lens is 30 to 40 mm. This light amount correcting plate is placed on the original surface side or the photosensitive member side of the image forming lens.

Recently, the image reading apparatuses as described above are under market pressure to have a wide zoom magnification range and a small size.

For example, in a so-called mirror zoom type image reading apparatus which uses a single-focus lens as an image forming lens and changes the magnification by moving the lens and reflecting mirrors to predetermined positions, the moving amounts of the lens and the reflecting mirrors increase as the zoom range widens. In a 6-mirror image reading apparatus in which a first reflecting mirror, and a second through a sixth reflecting mirror are each arranged in this order from the original surface side, the magnification is changed by changing the total optical path length by moving the fourth and fifth reflecting mirrors. When equal-magnification copying or enlarged copying is performed in an image reading apparatus of this type, the gap between the third reflecting mirror and the lens narrows during full scan. Also, the lens and the fourth reflecting mirror move closer to each other upon minimum reduction.

If the aforementioned method of placing the light amount correcting plate at a fixed distance from the lens is used to obtain uniform exposure surface illuminance of the photosensitive member, the light amount correcting plate and the third reflecting mirror unavoidably interfere with each other when equal-magnification copying is performed. Alternatively, the light amount correcting plate and the fourth reflecting mirror unavoidably interfere with each other when reduced copying is performed.

In the conventional mirror zoom type image reading apparatus, therefore, a gap of at least 30 to 40 mm is formed from the end face (lens surface) of the image forming lens as a space for placing the light amount correcting plate to avoid the interference between the light amount correcting plate and the reflecting mirrors. However, this increases the size of the apparatus because the gap of at least 30 to 40 mm is formed from the end face (lens surface) of the image forming lens.

SUMMARY OF THE INVENTION

The present invention has been designed in light of the above described problems of conventional image reading apparatuses and has as its objectives the provision of an image reading apparatus which can accurately read or write an image on an original surface by correcting an uneven light amount on the surface of a reading means, even when the magnification is changed, by intercepting a part of a light beam from the image, illuminated by an illuminating means, by using light amount correcting members attached to an image forming lens (image forming means) via movable members, and which can be made compact.

The image reading apparatus according to the present invention has the following characteristics as means for achieving the above objectives.

The image reading apparatus of the present invention is an image reading apparatus for illuminating an image on an original plate with a light beam from an illuminating means, guiding the light beam from the image onto the surface of a reading means by an image forming means which moves in the direction of the optical axis where and the reading means reads the image, wherein the image forming means has a movable member which moves in such optical axis direction, and where the movable member has light amount correcting members capable of facing or retracting from the front and rear surfaces of the image forming means along the optical axis direction of the image forming means, and where the light amount correcting members intercept a part of the light beam reflected from the image.

Also, the image reading apparatus of the present invention is an image reading apparatus for illuminating an image on an original plate with a light beam from illuminating means, guiding the light beam from the image onto the surface of reading means by an image forming means which moves in an optical axis direction, and the reading means reads the image, wherein the image forming means has a movable member which moves in the optical axis direction, and light amount correcting members for intercepting a part of the light beam from the image are attached to two end portions of the movable member which correspond to front and rear portions in the optical axis direction of the image forming means, the light amount correcting members facing or retracting from front and rear image forming means surfaces in the optical axis direction of the image forming means.

In the above image reading apparatuses, the image forming means changes a magnification by moving in the optical axis direction.

In the above image reading apparatuses, the movable member moves in the optical axis direction in accordance with the movement of the image forming means, the light amount correcting member which is farthest from the image forming means faces a corresponding front or rear image forming means surfaces in the optical axis direction of the image forming means to intercept a part of the light beam from the image in accordance with the movement of the movable member, and the other light amount correcting member, i.e. the one closer to the image forming means, retracts from the corresponding front or rear image forming means surfaces, as the case may be, in the optical axis direction of the image forming means in accordance with the movement of the movable member.

In the above image reading apparatuses, letting X be the spacing between locations where the light amount correcting members are attached to the movable member, L0 be the total length of the image forming means, and L1 be the distance from an image forming means surface of the image forming means to a light amount correcting member facing the image forming means surface, the image forming means, the movable member, and the light amount correcting members satisfy the following equation:

$$X \leq L0 + L1$$

In the above image reading apparatuses, the movable member moves while the image forming means moves to a position corresponding to a predetermined magnification, and a movement switching member for moving the movable member so as to make the light amount correcting members face or retract from the front and/or rear surfaces of the image forming means in the optical axis direction is placed in a position where the movement switching member does not intercept the optical path of the image forming means.

The above image reading apparatuses further comprise a reflecting member for guiding the light beam from the image onto the surface of the reading means through the image forming means by moving in the optical axis direction when the image forming means changes a magnification, wherein when the image forming means reduces the light beam from the image, a light amount correcting member retracted from an image forming means surface of the image forming means overlaps with an upper portion of the reflecting member.

DETAILED DESCRIPTION OF THE PREFERRED EMBODIMENT

An embodiment of the image reading apparatus according to the present invention will be described in detail below with reference to the accompanying drawings.

This embodiment of the image reading apparatus is a so-called mirror zoom type scanning exposure copying machine which uses a single-focus lens as an image forming lens (image forming means) and changes the magnification by moving the image forming lens and reflecting mirrors (reflecting members) to predetermined positions.

More specifically, this mirror zoom type scanning exposure copying machine has six reflecting mirrors. Two of these six reflecting mirrors are moved together with the image forming lens in the optical axis direction, so that the total optical path length is varied and also so that the optical path lengths in front and in back of the image forming lens are varied to obtain variable-magnification images.

Figure 1A:
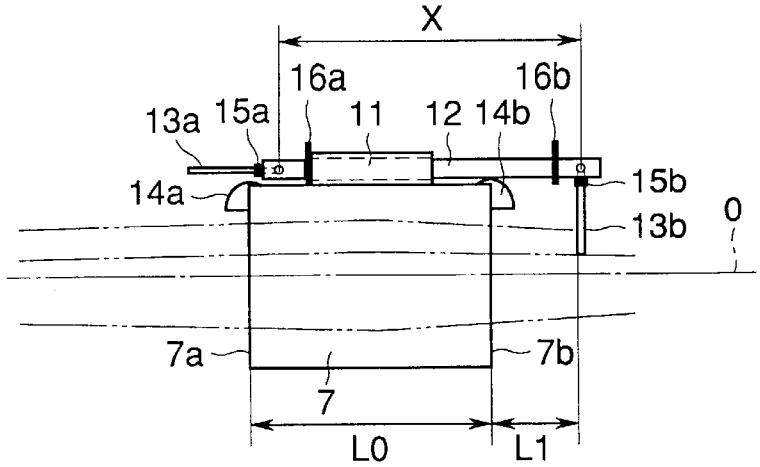
FIGS. 1A, 1B and 1C are views for depicting an image forming lens, movable members, light amount correcting plates, and a switching lever in a scanning exposure copying machine according to an embodiment of the present invention.
Figure 1B:
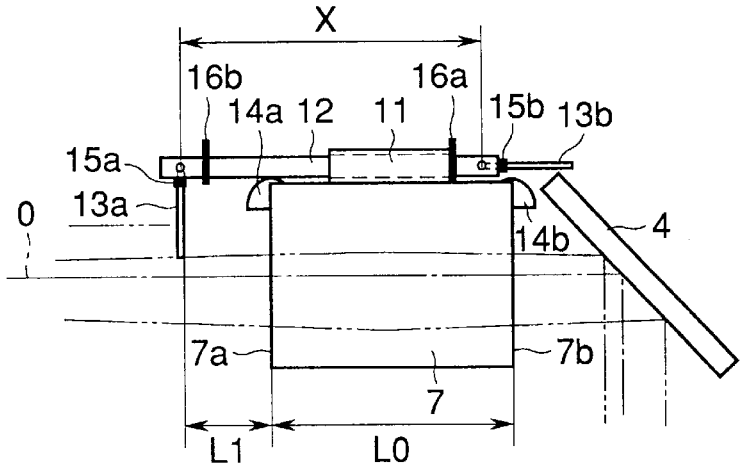
Figure 1C:
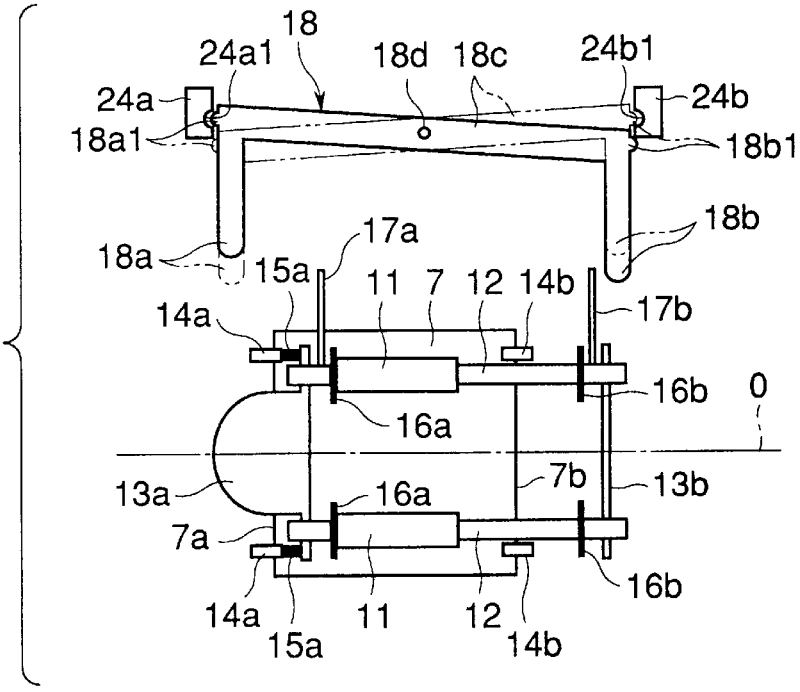

FIGS. 1A to 1C are views for depicting the image forming lens, movable members, light amount correcting plates, and a switching lever in the scanning exposure copying machine according to the embodiment of the present invention. Specifically, FIG. 1A shows the positions of the movable members and the light amount correcting plates with respect to the image forming lens when equal-magnification copying is performed. FIG. 1B shows the positions of the movable members and the light amount correcting plates with respect to the image forming lens when minimum reduction copying is performed. FIG. 1C shows the positional relationships between the image forming lens, the movable members, the light amount correcting plates, and the switching lever.

Figure 2:
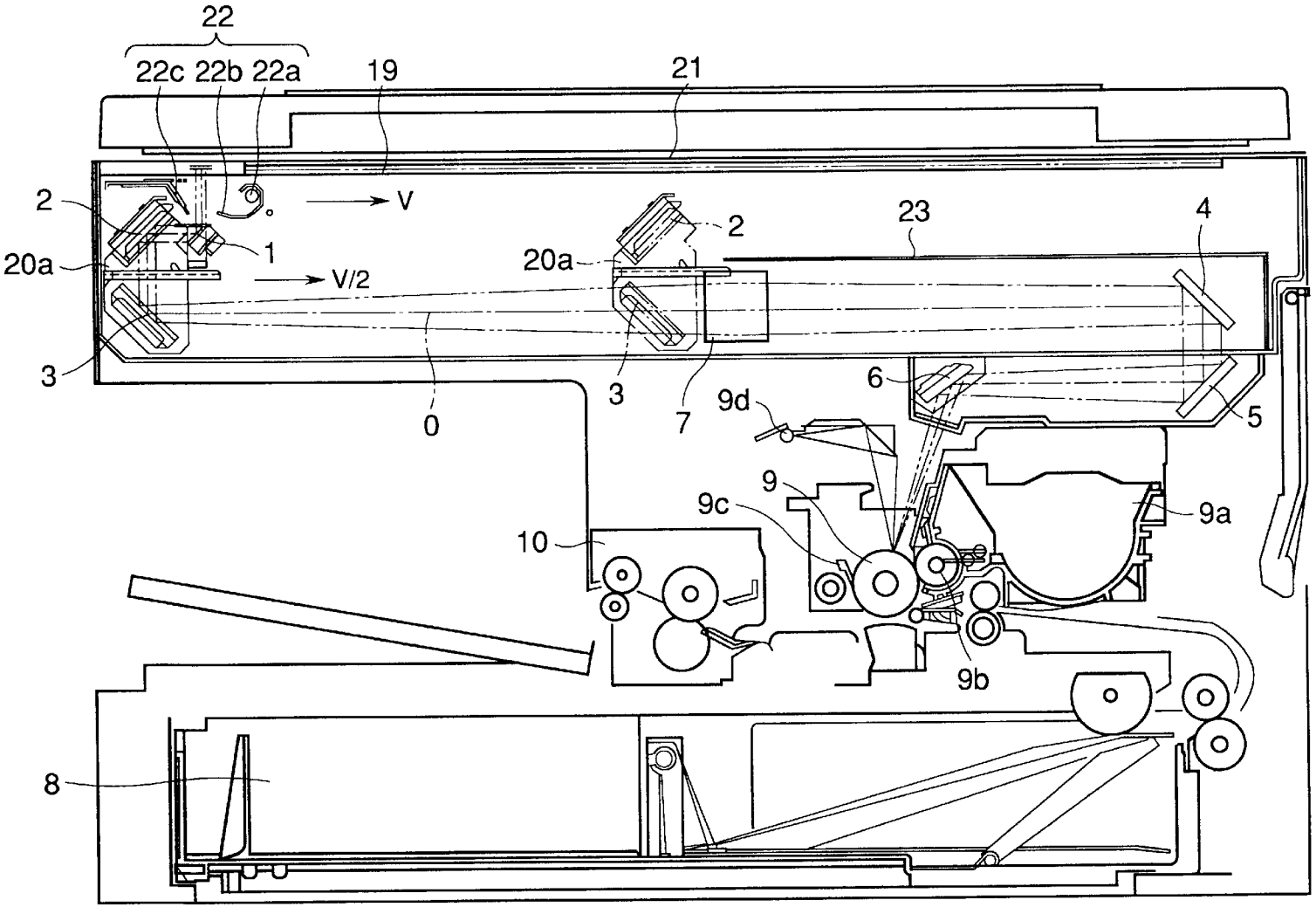
FIG. 2 is a view for depicting the positional relationships between the image forming lens and reflecting mirrors when equal-magnification copying is performed in the scanning exposure copying machine.

FIG. 2 is a view for depicting the positional relationships between the image forming lens and the reflecting mirrors when equal-magnification (100%) copying is performed in a scanning exposure copying machine.

Figure 3:
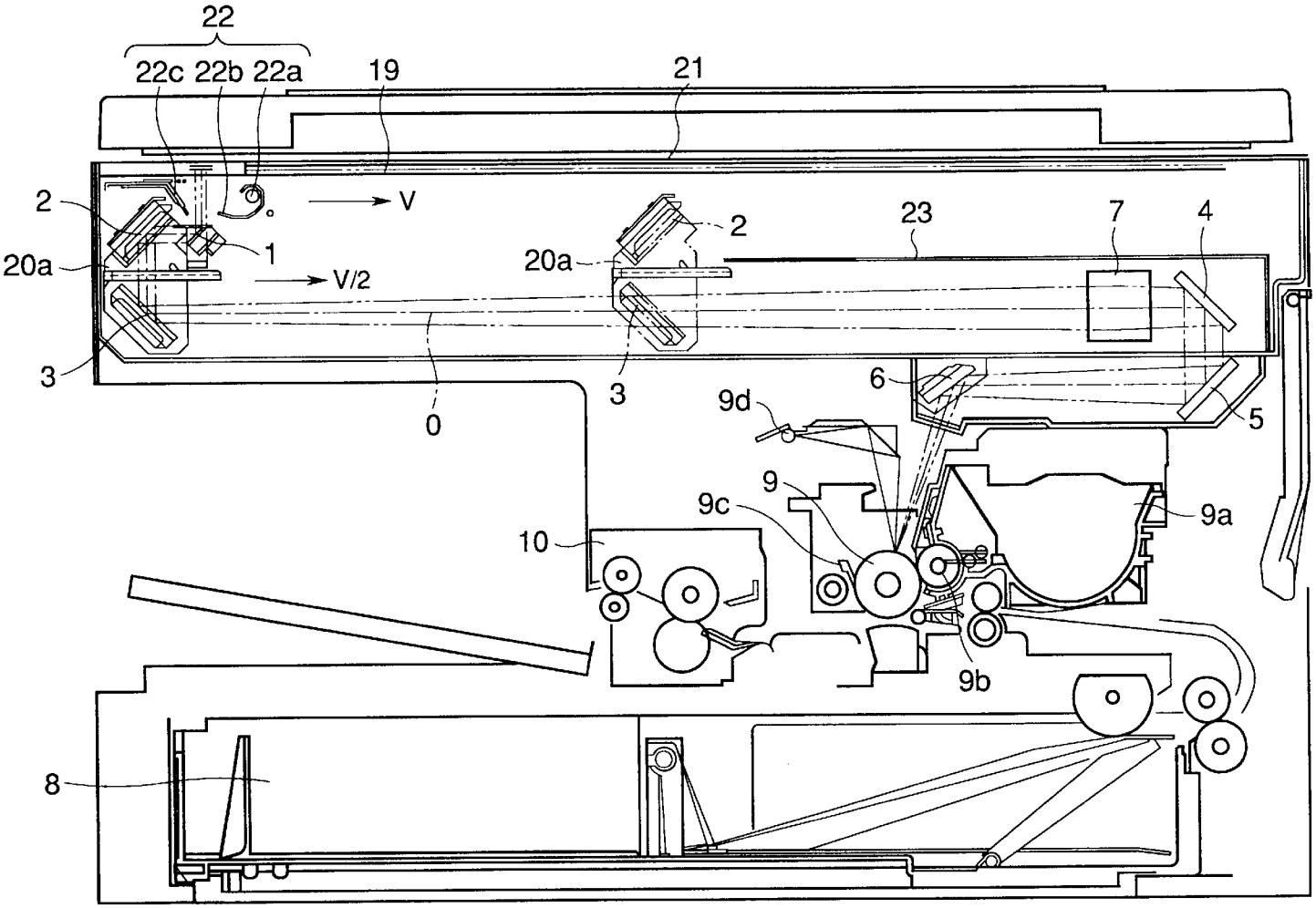
FIG. 3 is a view for depicting the positional relationships between the image forming lens and the reflecting mirrors when minimum-magnification (minimum reduction) copying is performed in the scanning exposure copying machine.

FIG. 3 is a view for indicating the positional relationships between the image forming lens and the reflecting mirrors when minimum-magnification (minimum reduction) (50%) copying is performed in a scanning exposure copying machine.

In FIGS. 2 and 3, the components such as movable members and the light amount correcting plates for the image forming lens are omitted.

Figure 4A:
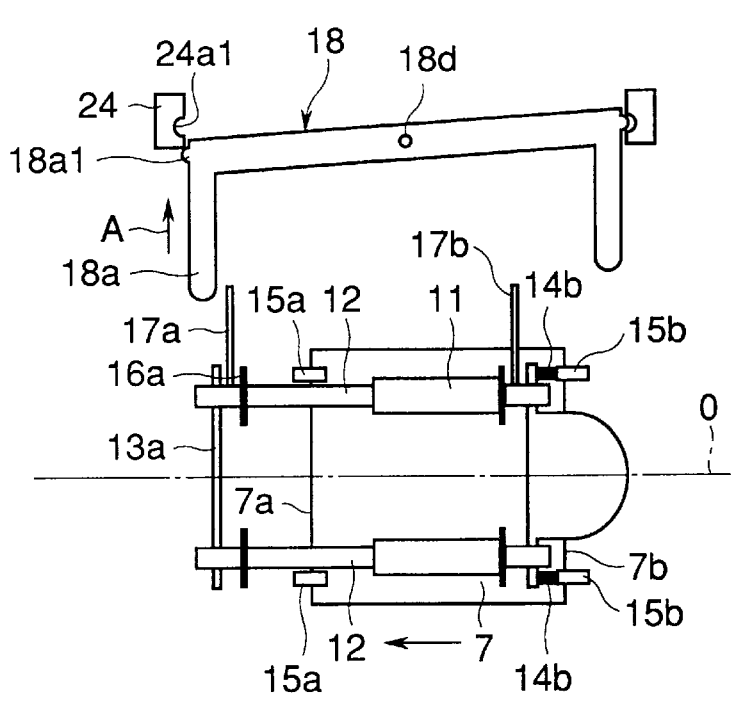
FIGS. 4A and 4B are views for depicting the operations of the movable members, the light amount correcting plates, and the switching lever when equal-magnification copying is performed in the scanning exposure copying machine.
Figure 4B:
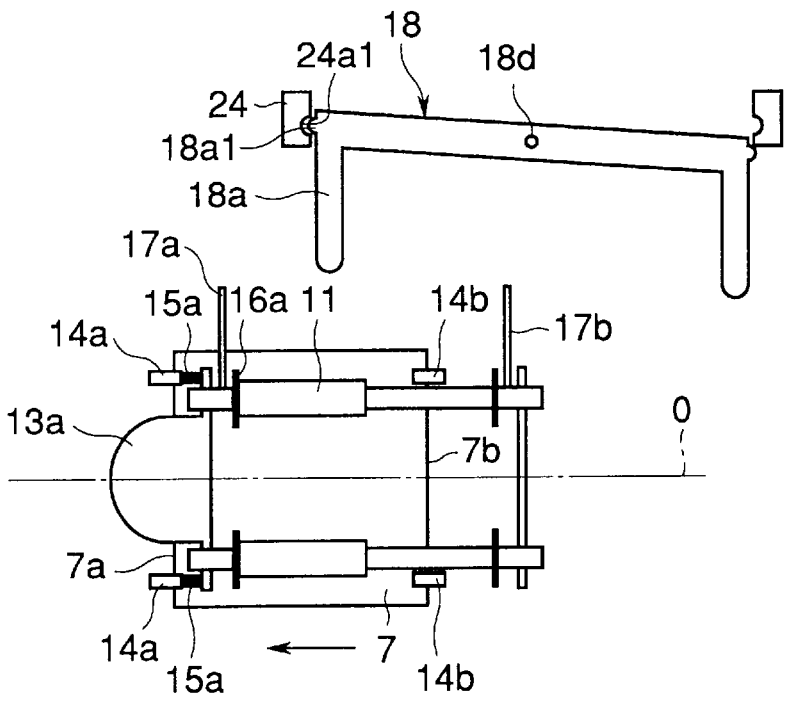

FIGS. 4A and 4B are views for explaining the operations of the movable members, the light amount correcting plates, and the switching lever when equal-magnification copying is performed in the scanning exposure copying machine.

Figure 5A:
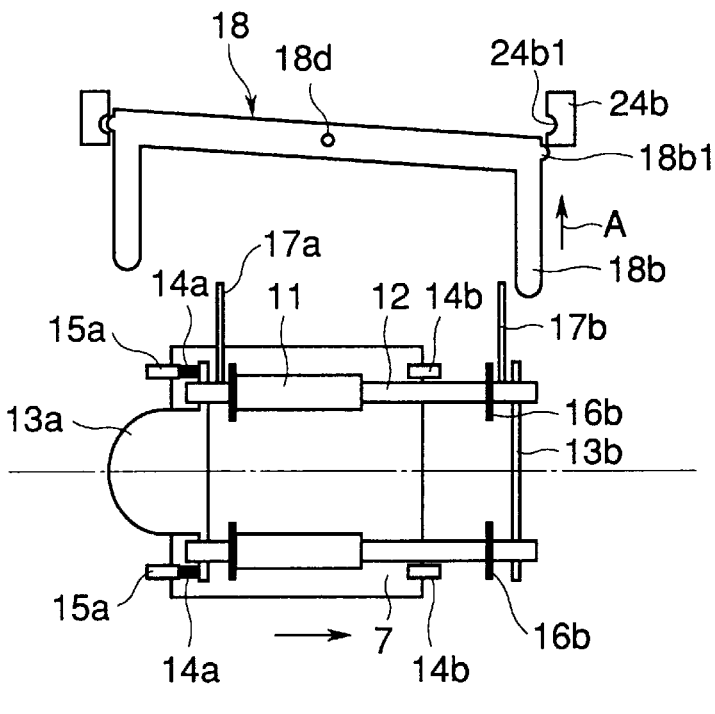
FIGS. 5A and 5B are views for depicting the operations of the movable members, the light amount correcting plates, and the switching lever when minimum reduction copying is performed in the scanning exposure copying machine.
Figure 5B:
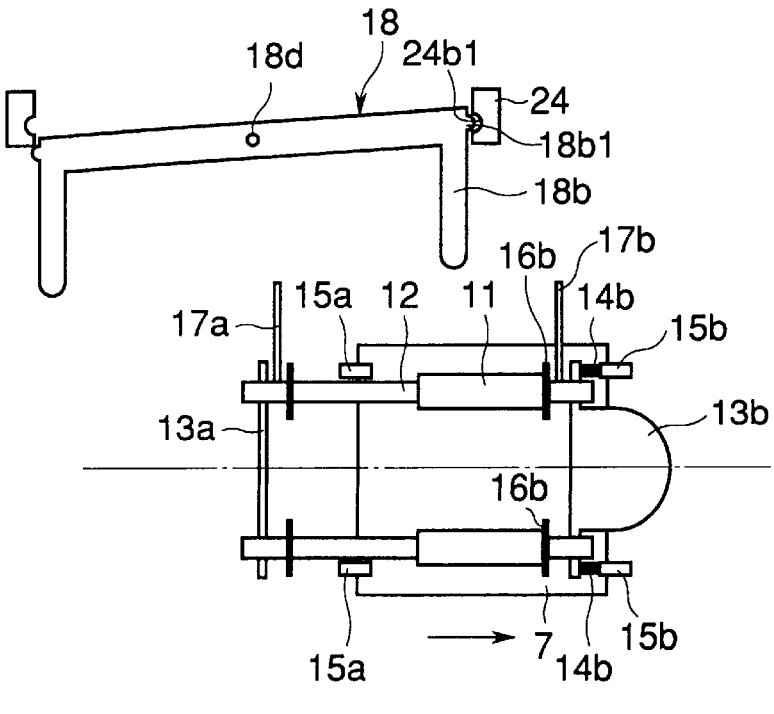

FIGS. 5A and 5B are views for explaining the operations of the movable members, the light amount correcting plates, and the switching lever when minimum reduction copying is performed in a scanning exposure copying machine.

Referring to FIGS. 2 and 3, an original plate 19 is made of transparent platen glass. An original (image) 21 is placed on this original plate 19.

A light source 22*a*, e.g., a fluorescent lamp or a halogen lamp having a linear light emitting surface extending in a direction (main scan direction) perpendicular to the paper is shown. Alternatively, a plurality of light sources 22*a* can also be used. A concave reflecting mirror 22*b* condenses light beams emitted by the light source 22*a* in a direction opposite to the surface of the original 21, and returns the light beam to the light source 22*a*, thereby increasing the illuminating efficiency on the surface of the original 21. Another concave reflecting mirror 22*c* condenses light beams emitted from the light source 22*a* in a direction substantially parallel to the surface of the original 21 and illuminates the surface of the original 21 with its outputted condensed light beam, thereby, increasing the illuminating efficiency on the surface of the original 21. The light,source 22*a* and the two concave reflecting mirrors 22*b* and 22*c* are components constituting an illuminating means 22.

Scanning reflecting mirrors 1 to 3 bend the optical path by reflecting the light beam from the surface of the original 21 on the original plate 19 and guide the light beam to an image forming lens 7. The first reflecting mirror 1, and the illuminating means 22, scan in the sub-scan direction at a predetermined velocity, V. The second and third reflecting mirrors 2 and 3 scan in the same direction at one half the velocity V, or at V/2. The image forming lens 7 forms an image of the light beam on a photosensitive drum (light receiving medium) 9 via fourth, fifth, and sixth reflecting mirrors 4, 5, and 6, thereby forming an electrostatic latent image.

A reflecting mirror holder 20*a* for holding the second and third reflecting mirrors 2 and 3 is in home position as indicated by the solid lines, the before scan is started. This reflecting mirror holder 20*a* has moved to a position indicated by the alternate long and short dashed lines when the surface of the original 21 is completely scanned.

The electrostatic latent image formed on the surface of the photosensitive drum 9 is developed with a developer (toner) by a well-known electrophotographic image formation method. This toner image on the surface of the photosensitive drum 9 is transferred to a recording material (not shown) such as a paper sheet supplied from a paper supply unit 8. The transferred toner image is melted and fixed to the recording material by a heat-fixing unit 10.

A developer container 9*a* contains the developer. A developing roller 9*b* develops the electrostatic latent image on the surface of the photosensitive drum 9 with the developer contained in the developer container 9*a*. A cleaning blade 9*c* removes any developer remaining on the surface of the photosensitive drum 9. An exposure lamp 9*d* removes any residual electric charge on the surface of the photosensitive drum 9. A light shielding lens hood 23 is provided for the image forming lens 7.

As shown in FIGS. 1A, 1B, and 1C, the image forming lens 7 has a pair of bar-like movable members 12. These movable members 12 are movably attached in the direction of an optical axis 0 via hollow guides 11 integrated with the image forming lens 7. Light amount correcting plates 13*a* and 13*b* acting as light amount correcting members for intercepting a part of a light beam from an image are pivotably installed on the end portions of the two movable members 12 such that the light amount correcting plates 13*a* and 13*b* face the front and rear image forming lens surfaces 7*a* and 7*b* in the optical axis O direction of the image forming lens 7, respectively, and also retract therefrom.

In the end portions of the movable members 12, stoppers 16*a* and 16*b* for regulating the movement of the movable members 12 along the optical axis O are provided at the inner side with respect to the light amount correcting plates 13*a* and 13*b*. In one of the two movable members 12, bar-like engaging members 17*a* and 17*b* are provided between the pivot portions of the light amount correcting plates 13*a* and 13*b* and the stoppers 16*a* and 16*b*. These engaging members 17*a* and 17*b* are adapted to come into contact with switching portions 18*a* and 18*b*, respectively, of a switching lever 18 (to be described later).

Leaping members 14*a*, 14*b*, 15*a* and 15*b* are provided on the opposite end portions of the light amount correcting plates 13*a* and 13*b* and those portions of the image forming lens 7 corresponding thereto. The leaping members 14*a*, 14*b*, 15*a* and 15*b* function as guide when the light amount correcting plates 13*a* and 13*b* are caused to be retracted from or face towards the image forming lens 7.

As shown in FIGS. 1A and 1B, letting X be the spacing between the locations where the light amount correcting plates 13 are attached in the opposite ends of the movable members 12, letting L0 be the total length of the image forming lens 7, and letting L1 be the distance from the image forming lens surface 7*a* of the image forming lens 7 to the light amount correcting plate 13 facing this image forming lens surface 7*a*, the image forming lens 7, the movable members 12, and the light amount correcting plates 13 satisfy the following equation:

$$X \leq L0 + L1$$

Thus, when full scan is performed during equal-magnification copying, as shown in FIG. 2, it is possible to prevent the light amount correcting plate 13*a* in front of the image forming lens 7 from intercepting the light beam guided from the second reflecting mirror 2 to the third reflecting mirror 3. The reason for this will be described below.

In equal-magnification copying, as shown in FIG. 2, the movable members 12 are moved backward (toward the fourth reflecting mirror 4) relative to the image forming lens 7, along the optical axis O, by the switching lever 18 (to be described later). Consequently, as shown in FIG. 1A, the light amount correcting plate 13*b* on the back (far) side (on the fourth reflecting mirror 4 side) relative to the image forming lens 7 is suspended so as to face the image forming lens surface 7*b*. The light amount correcting plate 13*a* on the front (near) side (on the third reflecting mirror 3 side), relative to the image forming lens 7, retracts from the image forming lens surface 7*a*.

In this state, the light amount correcting plate 13*a* in front of the image forming lens 7 partially overlaps the image forming lens 7 and slightly projects forward from the image forming lens surface 7*a* of the image forming lens 7.

When full scan is performed in equal-magnification copying, therefore, the front light amount correcting plate 13*a* does not intercept the light beam guided from the second reflecting mirror 2 to the third reflecting mirror 3. However, an uneven light amount on the surface of the photosensitive drum 9 can also be corrected by the rear light amount correcting plate 13*b*. As a consequence, the image on the surface of the original 21 can be accurately written on the surface of the photosensitive drum 9.

Alternatively, when minimum-magnification (reduction) copying, as shown in FIG. 3 is performed, an increased space occupied by the light amount correcting plate 13*b* behind the image forming lens 7 can be eliminated. This makes the whole apparatus compact. The reason for this will be described below.

In minimum-magnification (reduction) copying, as shown in FIG. 3, the movable members 12 are moved forward (toward the third reflecting mirror 3), relative to the image forming lens 7, along the optical axis O by the switching lever 18 (to be described later). Consequently, as shown in FIG. 1B, the light amount correcting plate 13*a* on the front (far) side (the third reflecting mirror 3 side) with respect to the image forming lens 7 is suspended so as to face the image forming lens front surface 7*a*. The light amount correcting plate 13*b* on the back (near) side (i.e. the fourth reflecting mirror 4 side) of the image forming lens rear 7 retracts from the image forming lens surface 7*b*.

In this state, the light amount correcting plate 13*b* behind the image forming lens 7 partially overlaps the image forming lens 7 and slightly projects backward from the image forming lens surface 7*b* of the image forming lens 7. Accordingly, when minimum-magnification (reduction) copying is performed the rear light amount correcting plate 13*b* can be so retracted as to partially overlap the upper portion of the fourth reflecting mirror 4.

That is, in the above-mentioned minimum-magnification (reduction) copying as shown in FIG. 3, the image forming lens 7 can be moved toward the fourth reflecting mirror 4 by a larger distance than in the equal-magnification copying shown in FIG. 2. Also, the fourth and fifth reflecting mirrors 4 and 5 can be moved to the right. Furthermore, as can be seen from FIGS. 2 and 3, a space for a common light amount correcting plate fixed to a lens need not be formed between the third reflecting mirror 3 and the image forming lens 7 when equal-magnification full scan is performed or between the image forming lens 7 and the fourth reflecting mirror 4 when minimum-magnification (reduction) copying is performed. This makes the whole apparatus compact.

Thus, in minimum-magnification (reduction) copying, an uneven light amount on the surface of the photosensitive drum 9 can be corrected by the front light amount correcting plate 13*a*. As a consequence, the image on the surface of the original 21 can be accurately written on the surface of the photosensitive drum 9.

Referring to FIG. 1C, the switching lever 18 is a movement switching means for switching the movements of the two movable members 12 along the optical axis O. Holding members 24*a* and 24*b* temporarily fix the switching lever 18.

The switching lever 18 has the switching portions 18*a* and 18*b* at the opposite ends of a lever main body 18*c* extending along the optical axis O of the image forming lens 7. Thus the switching lever 18 has a substantially U shape in the plan view. This switching lever 18 is placed in a substantially central portion of the light shielding lens hood 23 so as not to intercept the optical path of the image forming lens 7. A substantially central portion of the lever main body 18*c* is pivotably supported by the light shielding lens hood 23 via a shaft 18*d* such that the lever main body 18*c* can pivot on the shaft 18*d*. Dowels 18*a*1 and 18*b*1 are formed on those outer surfaces of the switching portions 18*a* and 18*b* in the optical axis O of the image forming lens 7.

The holding members 24*a* and 24*b* are fixed to the light shielding lens hood 23 in the vicinities of the switching portions 18*a* and 18*b* of the switching lever 18. Recesses 24*a*1 and 24*b*1 for receiving the dowels 18*a*1 and 18*b*1 of the switching portions 18*a* and 18*b* of the switching lever 18 are formed in the holding members 24*a* and 24*b*, respectively.

The switching lever 18 switches the movements of the movable members 12 along the optical axis O as described in what follows.

Operation when the switching lever 18 switches the movements of the movable members 12 in equal-magnification copying, as shown in FIG. 2, will be first described.

In the course of movement of the image forming lens 7 in the state shown in FIG. 1B (minimum reduction state) from the right to the left in FIG. 4A along the optical axis O, the front engaging member 17*a* (on the front, or third reflecting mirror 3, side) of the movable members 12 comes in contact with and pushes the front switching portion 18*a* (on the third reflecting mirror 3 side) of the switching lever 18. At the same time the engaging member 17*a* of the movable members 12 pushes the switching portion 18*a* of the switching lever 18, the movable members 12 move backward (toward the fourth reflecting mirror 4) with respect to the image forming lens 7.

In the course of the backward movement of the movable members 12, the guide members 15*a* of the front light amount correcting plate 13*a* of the movable members 12 and the front guide members 14*a* of the image forming lens 7 interfere with each other. Accordingly, the front light amount correcting plate 13*a* retracts from the image forming lens surface 7*a* of the image forming lens 7. Also, the guide members 15*b* of the rear light amount correcting plate 13*a* of the movable members 12 are released from the interference with the rear guide members 14*b* of the image forming lens 7. Hence, the rear light amount correcting plate 13*b* is caused to be suspended so as to face the image forming lens surface 7*b* of the image forming lens 7. Consequently, as shown in FIGS. 1A and 4B, the rear light amount correcting plate 13*b* can intercept light during equal-magnification copying.

When the movable members 12 move backward and the front stoppers 16*a* abut against the guides 11 of the image forming lens 7, the image forming lens 7 further moves while pushing the front stoppers 16*a* of the movable members 12 by the guides 11. Accordingly, the engaging member 17*a* of the movable members 12 further pushes the switching portions 18*a* of the switching lever 18, so that the switching lever 18 pivots in a direction designated as A in FIG. 4B, around the shaft 18*d*, and the dowel 18*a*1 of the switching portion 18*a* enters the recess 24*a*1 of the holding member 24*a*. Consequently, the switching lever 18 is temporarily fixed by the holding member 24*a*, so that the rear engaging member 17*b* of the movable members 12 does not interfere with the switching portion 18*a* of the switching lever 18 any longer.

Now, operation when the switching lever 18 switches the movements of the movable members 12 in minimum-magnification (reduction) copying, as shown in FIG. 3, will be next described.

In the course of movement of the image forming lens 7 in the state shown in FIG. 1A (equal-magnification state) from the left to the right in FIG. 5A along the optical axis O, the rear engaging member 17*b* (on the "rear" or side nearest the fourth reflecting mirror 4) of the movable members 12 comes in contact with and pushes said rear switching portion 18*b* (on the fourth reflecting mirror 4 side) of the switching lever 18. At the same time the engaging member 17*b* of the movable members 12 pushes the switching portion 18*b* of the switching lever 18, the movable members 12 move forward (towards the third reflecting mirror 3) with respect to the image forming lens 7.

In the course of the forward movement of the movable members 12, the guide members 15*b* of the rear light amount correcting plate 13*b* of the movable members 12, and the rear guide members 14*b* of the image forming lens 7, interfere with each other. Accordingly, the rear light amount correcting plate 13*b* retracts from the image forming lens surface 7*b* of the image forming lens 7. Also, the guide members 15*a* of the front light amount correcting member 13*a* of the movable members 12 are released from interfering with the front guide members 14*a* of the image forming lens 7. Thus, the front light amount correcting member 13*a* is caused to be suspended so as to face the image forming lens surface 7*a*. Consequently, as shown in FIGS. 1B and 5B, the front light amount correcting plate 13*a* can intercept light during minimum-magnification (reduction) copying.

When the movable members 12 move forward and the rear stoppers 16*b* abut against the guides 11 of the image forming lens 7, the image forming lens 7 further moves while pushing the rear stoppers 16*b* of the movable members 12 by the guides 11. Accordingly, the engaging member 17*b* of the movable members 12 further pushes the switching portion 18*b* of the switching lever 18. The switching lever 18 pivots in a direction A (as depicted in FIG. 5(A)) around the shaft 18*d*, and the dowel 18*b*1 of the switching portion 18*b* enters the recess 24*b*1 of the holding member 24*b*. Consequently, the switching lever 18 is temporarily fixed by the holding member 24*b*, so that the rear engaging member 17*a* of the movable members 12 does not interfere with the switching portion 18*b* of the switching lever 18 any longer.

As described above, when the image forming lens 7 moves from the equal-magnification position to the minimum-magnification (reduction) position, the switching lever 18 preferably switches the movements of the movable members 12. When copying is performed at magnifications between the equal magnification and the minimum magnification (reduction), the switching lever 18 similarly switches the movements of the movable members 12. That is, the image forming lens 7 is moved along the optical axis O until the rear light amount correcting plate 13*b* (on the fourth reflecting mirror 4 side) retracts from the image forming lens surface 7*b* of the image forming lens 7 and the front light amount correcting plate 13*a* (on the third reflecting mirror 3 side) is caused to be suspended so as to face the image forming lens surface 7*a* of the image forming lens 7. When this is the case, an extra operation is performed until the image forming lens 7 comes to a predetermined magnification position. However, this operation has little influence because magnification switching is performed within a short time period.

In the scanning exposure copying machine of this embodiment as described above, when enlarged copying or equal-magnification copying is performed, the optical amount correcting plate 13*b* on the rear side (on the fourth reflecting mirror 4 side) of the image forming lens 7 is suspended so as to face the image forming lens surface 7*b* of the image forming lens 7. This allows the rear light amount correcting plate 13*b* to preferably correct any uneven light amount on the surface of the photosensitive drum 9, so that the image on the surface of the original 21 can be accurately written on the surface of the photosensitive drum 9. Additionally, the light amount correcting plate 13*a* on the front side (on the third reflecting mirror 3 side) of the image forming lens 7 retracts from the image forming lens surface 7*a* of the image forming lens 7. As a result, it is possible to avoid interference between the third reflecting mirror 3 and this light amount correcting plate 13*a* during full scan.

When minimum-magnification (reduction) copying is performed, the light amount correcting plate 13*a* on the front side (on the third reflecting mirror 3 side) of the image forming lens 7 is suspended so as to face the image forming lens surface 7*a* of the image forming lens 7. This allows the front light amount correcting plate 13*a* to preferably correct any uneven light amount on the surface of the photosensitive drum 9, so that the image on the surface of the original 21 can be accurately written on the surface of the photosensitive drum 9. Additionally, the light amount correcting plate 13*b* on the rear side (on the fourth reflecting mirror 4 side) of the image forming lens 7 retracts from the image forming lens surface 7*b* of the image forming lens 7. It is thus possible to avoid interference between the fourth reflecting mirror 4 and this light amount correcting plate 13*b*.

Furthermore, the light amount correcting plates 13*a* and 13*b* partially overlap the image forming lens 7 when retracting from the image forming lens surfaces 7*a* and 7*b* of the image forming lens 7. For example, therefore, the light amount correcting plate 13*a*, which retracts when enlarged copying or equal-magnification copying is performed, does not intercept the light beam guided from the second reflecting mirror 2 to the third reflecting mirror 3 during full scan. As a result of the aforementioned apparatus, the whole apparatus can be made compact.

The present invention is not limited to the above embodiment. For example, as another possible switching means for switching the movements of the movable members 12 with respect to the image forming lens 7, a member for moving the movable members 12 forward with respect to the image forming lens 7 can be placed above the fourth reflecting mirror 4, and a member for moving the movable members 12 backward with respect to the image forming lens 7 can be provided in a portion above and close to the exit of the light shielding lens hood 23.

In the above embodiment, the photosensitive drum 9 is taken as an example of a reading means (light receiving medium). However, it is also possible to use, e.g., a line sensor in which a plurality of pixels are arranged in a direction perpendicular to the paper and to read image information on the original surface by decoding the output signal from the line sensor.

The above embodiment has been described by taking the mirror zoom type scanning exposure copying machine as an example. However, the present invention is similarly applicable to a zoom lens type variable magnification copying apparatus in which the fourth, fifth, and sixth reflecting mirrors 4, 5, and 6 are fixed and the magnification is changed by zooming the image forming lens 7.

As has been described above, the present invention provides an image reading apparatus by which an image on an original plate is illuminated with a light beam from an illuminating means, the light beam from the original is guided to the surface of a reading means by an image forming means which moves in an optical axis direction, and the image is read by the reading means. In this apparatus, the image forming means has movable members capable of moving in the optical axis direction. These movable members have light amount correcting members capable of facing or retracting from front and rear image forming means surfaces, respectively, in the direction of the optical axis of the image forming means. These light amount correcting members intercept a part of the light beam from the image. Accordingly, it is possible to provide an image reading apparatus which can accurately read or write an image on an original surface by correcting an uneven amount of light on the surface of a reading means even when the magnification is changed, over a large dynamic range and which can further be made compact.

What is claimed is:

1. An image reading apparatus comprising:

illuminating means for illuminating an image on an original plate;

reading means for reading the image;

image forming means for guiding a light beam from the image onto a surface of said reading means, said image forming means moving in an optical axis direction;

a movable member attached to said image forming means to move in the optical axis direction; and light amount correcting members attached to said movable member, said light amount correcting members being operable to face towards or retract from, as necessary, the front and/or rear image forming means surfaces in the optical axis direction of said image forming means, said light amount correcting members intercepting a part of the light beam from the image.

2. An apparatus according to claim 1, wherein said reading means is a photosensitive drum.

3. An apparatus according to claim 1, wherein said image forming means changes a magnification by moving in the optical axis direction.

4. An apparatus according to claim 1, wherein said movable member moves in the optical axis direction in accordance with the movement of said image forming means, one of said light amount correcting members farther from said image forming means faces a corresponding one of the front and rear image forming means surfaces in the optical axis direction of said image forming means to intercept a part of the light beam from the image in accordance with the movement of said movable member, and the other one of said light amount correcting members closer to said image forming means retracts from a corresponding one of the front and rear image forming means surfaces in the optical axis direction of said image forming means in accordance with the movement of said movable member.

5. An apparatus according to claim 1, wherein letting X be a spacing between portions where said light amount correcting members are attached to said movable member, L0 be a total length of said image forming means, and L1 be a distance from an image forming means surface of said image forming means to a light amount correcting member facing the image forming means surface, said image forming means, said movable member, and said light amount correcting members satisfy:

$$X \leq L0 + L1.$$

6. An apparatus according to claim 1, wherein said movable member moves while said image forming means moves to a position corresponding to a predetermined magnification, and a movement switching member for moving said movable member so as to make said light amount correcting members face or retract from the front and rear image forming means surfaces in the optical axis direction of said image forming means is provided in a position where said movement switching member does not block an optical path of said image forming means.

7. An apparatus according to claim 1, further comprising a reflecting member which is moved in the optical axis direction to guide the light beam from the image onto the surface of said reading means through said image forming means when a magnification of said image forming means is changed, wherein when said image forming means reduces the light beam from the image, a light amount correcting member retracted from an image forming means surface of said image forming means overlaps an upper portion of said reflecting member.

8. An apparatus according to claim 1, wherein said light amount correcting members are attached to opposite end portions of said movable member which correspond to front and rear portions in the optical axis direction of said image forming means.

* * * * *

UNITED STATES PATENT AND TRADEMARK OFFICE

CERTIFICATE OF CORRECTION

PATENT NO. : 6,032,009
DATED : February 29, 2000
INVENTOR(S) : Nobumasa Fukuzawa et al.

It is certified that error appears in the above-identified patent and that said Letters Patent is hereby corrected as shown below:

Column 1,
Line 10, "the part" should read -- a part --; and "a" should read -- the --;
Line 11, "image" should read -- image, which is --;
Line 12, "the" should read -- an --;
Line 13, "(image" should read -- (the image --;
Line 14, "is a" should read -- in a --; and
Line 32, "(where" should read -- where --; and "light)." should read -- light. --.

Column 2,
Line 40, "above described" should read -- above-described --; and
Line 59, "and" should be deleted.

Column 3,
Line 50, "face" should read -- face towards --; and "from" should read -- from, as the case may be, --.

Column 4,
Line 62, "the" should be deleted; and "movable" should read -- the movable --.

Column 5,
Line 2, "the" should read -- a --;
Line 23, "thereby," should read -- thereby --;
Line 24, "light,source" should read -- light source --;
Line 35, "beam" should read -- beams --; and
Line 39, "position" should read -- position, --.

Column 6,
Line 27, "in" should read -- at --.

Column 7,
Line 19, "rear" should be deleted; and
Line 20, "surface 7b." should read -- rear surface 7b. --.

UNITED STATES PATENT AND TRADEMARK OFFICE

CERTIFICATE OF CORRECTION

PATENT NO. : 6,032,009
DATED : February 29, 2000
INVENTOR(S) : Nobumasa Fukuzawa et al.

It is certified that error appears in the above-identified patent and that said Letters Patent is hereby corrected as shown below:

Column 8,
Line 47, "pivots" should read -- pivots, --; and
Line 64, "said" should read -- the --.

Column 10,
Line 63, "front" should read -- the front --.

Column 11,
Line 4, "range" should read -- range, --.

Signed and Sealed this

Fifteenth Day of January, 2002

*Attest:*

*Attesting Officer*

JAMES E. ROGAN
*Director of the United States Patent and Trademark Office*